United States Patent [19]

Hightower

[11] 4,291,430

[45] Sep. 29, 1981

[54] JANITOR'S RAKE FOR REMOVING STAPLES IMBEDDED IN CARPET

[76] Inventor: Ronald Hightower, 89 Whiteford Ave., Atlanta, Ga. 30307

[21] Appl. No.: 151,540

[22] Filed: May 21, 1980

[51] Int. Cl.[3] ..... A47L 13/00

[52] U.S. Cl. ..... 15/142

[58] Field of Search ..... 15/105, 142, 402; 209/215; 56/400.01, 400.04, 400.21

[56] References Cited

U.S. PATENT DOCUMENTS

| | | | |
|---|---|---|---|
| 501,247 | 7/1893 | Goldsmith . | |
| 774,980 | 11/1904 | Cronk | 56/400.01 |
| 978,869 | 12/1910 | Fergusson . | |
| 1,657,752 | 1/1927 | Hertzberg . | |
| 1,859,132 | 5/1932 | Fechtenburg | 15/402 |
| 1,894,905 | 1/1933 | Fechtenburg . | |
| 1,936,369 | 11/1933 | Riebel, Jr. et al. | 15/402 |
| 2,251,626 | 10/1938 | Hertzberg . | |
| 3,206,783 | 9/1965 | Schwartz | 209/215 |
| 3,377,641 | 4/1968 | McGregor | 209/215 |
| 3,797,066 | 3/1974 | Zaidan | 15/402 |
| 3,838,474 | 10/1974 | Erickson . | |
| 3,929,142 | 12/1975 | Carfi . | |
| 3,999,244 | 12/1976 | Brickley . | |
| 4,042,995 | 8/1977 | Varon . | |
| 4,107,808 | 8/1978 | Schroder . | |
| 4,156,298 | 5/1979 | Spence | 15/142 |

*Primary Examiner*—Edward L. Roberts
*Attorney, Agent, or Firm*—Charles B. Lefkoff

[57] ABSTRACT

A device for dislodging standard staples having their side portions imbedded in carpet and for dislodging standard staples having their side portions hooked around carpet thread. A toothed member has teeth spaced such that standard staples' side portions will fit between two teeth with at least one other tooth between the two teeth, such that the staple will not turn out of the fit. The teeth are also spaced close enough such that a staple's hooked side portion will not fit between the teeth. Embodiments include the toothed member being the head of a hand rake and being the surface of a drum which is motorized.

9 Claims, 18 Drawing Figures

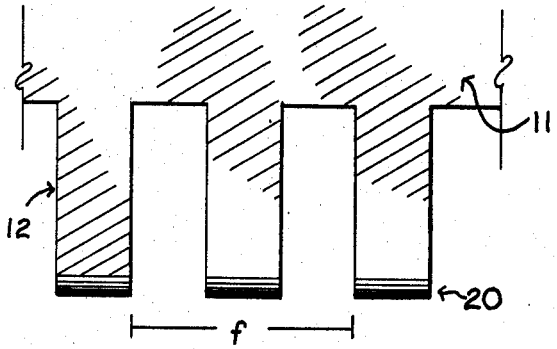
FIG 4.
FIG. 5.
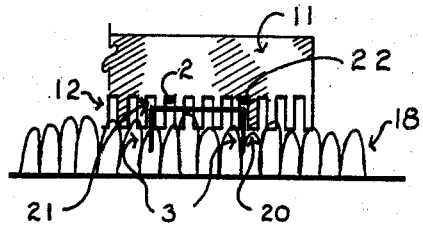
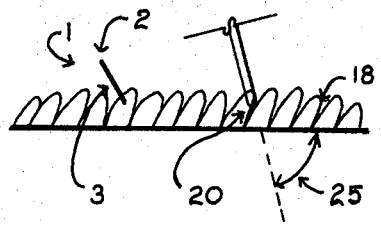
FIG. 6.
FIG. 8.
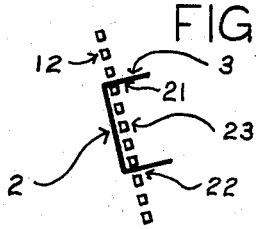
FIG. 9
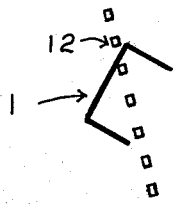
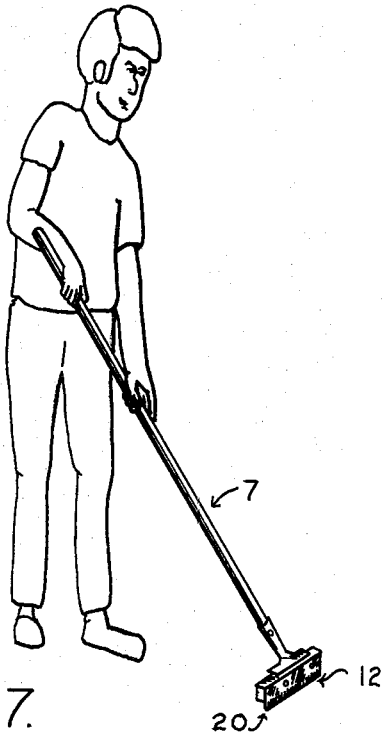
FIG. 7.

JANITOR'S RAKE FOR REMOVING STAPLES IMBEDDED IN CARPET

BACKGROUND OF THE INVENTION

1. Field of the Invention

This invention relates to carpet rakes and to devices for removing staples imbeded in carpet.

2. Description of the Prior Art

Since the advent of staple machines in office buildings, staples have fallen onto carpets and become lodged in carpets to a degree that vacuum cleaners are unable to dislodge them. This has been a horrendous janitorial problem for years and years. In areas such as accounts receivables sections and around copy machines, these lodged staples often blanket large areas of carpet. Many janitorial services do not even attempt to remove lodged staples in such areas where staples are dropped in large numbers daily. Others resort to individually pulling the staples out with a pair of pliers, or individually prying them up with some type of flat tool.

It has heretofore been inconceivable to dislodge these staples without concentrating on each one individually.

Toothed carpet rakes are in common use for removing loose matter on carpets such as threads and hairs, and for combing shag carpets. However, it has been heretofore inconceivable to use a rake to dislodge staples which have been dislodged only by gripping and pulling staples individually. The design of the instant invention is very far removed from carpet rakes known at the time the invention was made. Earlier carpet rakes were not built to withstand continuous downward force on the handle or constant pulling against the resistance of the staples.

Earlier carpet rakes do not have teeth spaced closely enough. Earlier rakes do not have teeth spacing such that a staple's two side portions each fit in different spaces between teeth. They also do not have spacing to resist the turning of a staple so fit. Earlier carpet rakes also do not have rigid teeth that are smaller than the loops of the carpet on which they are designed to be used.

Earlier carpet rakes are not designed to use a stock aluminum hair comb in such a way that the comb can be easily replaced.

SUMMARY OF THE INVENTION

This invention solves the long felt janitorial problem of dislodging fallen staples from carpet without individually gripping, pulling or prying the staples. The invention is a toothed device built such that the teeth are pressed down on the carpet and moved across the carpet against the staples. The teeth are spaced such that the staples' end portions will fit tightly between the teeth to resist a staple's turning out of the fit. The teeth are spaced closely enough so that the hooks of staples hooked around carpet thread will not fit between the teeth. A magnet is positioned to collect loose staples in the path of the teeth.

The teeth could be on a carpet rake or on the drum of a motorized machine. Both embodiments are built sturdy enough to withstand the constant pulling and pressing down on the teeth. A stock aluminum comb can be used in a rake embodiment in such a way that the teeth are reinforced and that the comb is easily replacable.

BRIEF DESCRIPTION OF THE DRAWINGS

FIG. 4 is a front view of three of the rake's teeth.

FIG. 5 is a front view of a staple with its side portions stuck in carpet and of the teeth of the rake approaching it.

FIG. 6 is a side view of a rake approaching the staple of FIG. 5.

FIG. 7 is an illustration of how a person holds the rake while using it.

FIG. 8 is a top view of the fit of a staple's side portions with the cut off teeth of a rake with proper teeth spacing.

FIG. 9 is a top view of a staple turning out of the fit of a rake with cut off teeth having improper spacing.

DESCRIPTION OF THE PREFERRED EMBODIMENTS

Figure 1:
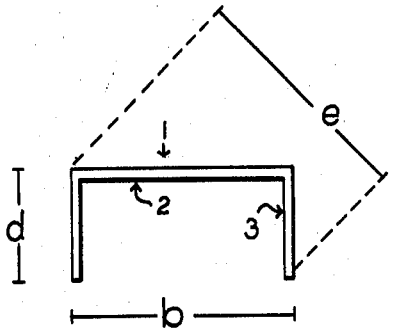
FIG. 1 is a front view of a staple.

FIG. 1 shows a staple 1 used in offices to join papers together. These staples have a mid portion 2 and two side portions 3. The most common size staples, known as standard staples, are made of steel wire approximately 0.019 inches in diameter. A standard staple's mid portion 2 has an outside length b of one half inch and its two side portions 3 each has an outside length d of one quarter inch. The staple's diagonal length e is also used herein.

Figure 2:
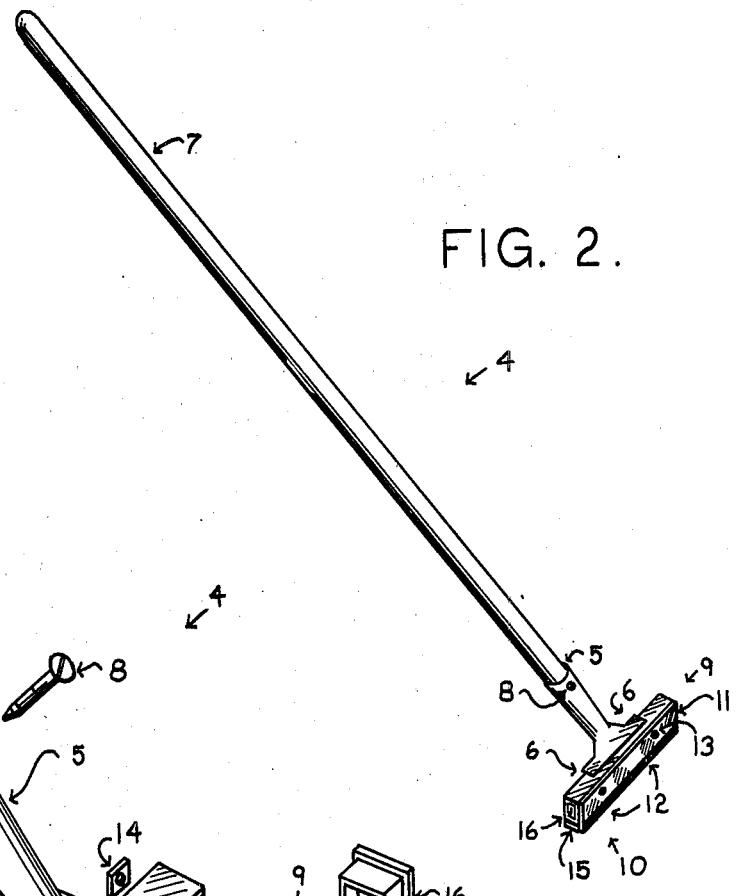
FIG. 2 is a perspective view of a staple rake.
Figure 3:
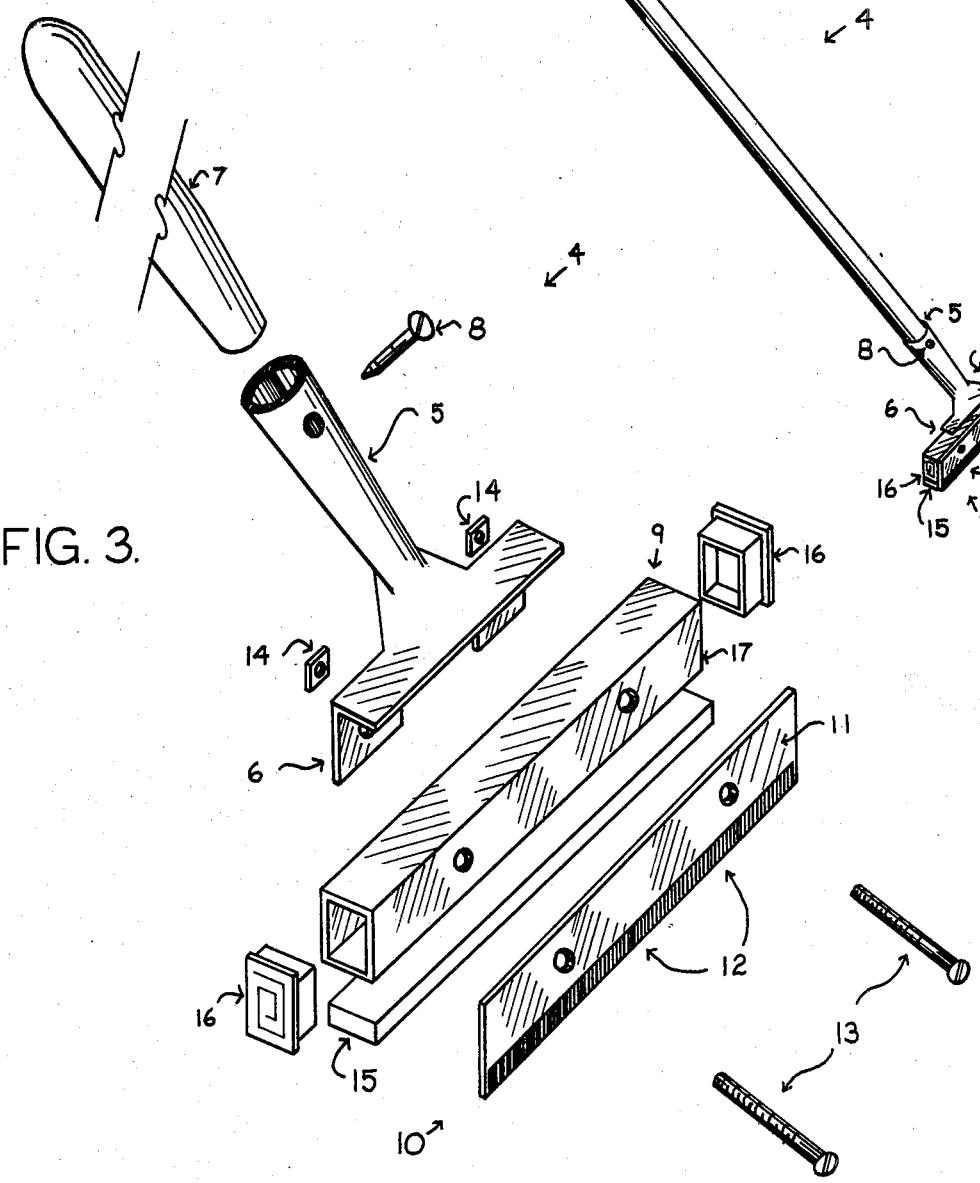
FIG. 3 is an exploded view of the staple rake in FIG. 2.

FIGS. 2 and 3 show a rake 4 designed to dislodge and collect staples 1 that are lodged in carpet. A substantially rod shaped handle comprises:

1. a rod such as a tapered stick 7,
2. a brace 5 having a flat end portion 6,
3. a wood screw 8 which attaches the stick 7 to the brace 5,
4. an aluminum square tube 9 having a flat front portion 17, and
5. a pair of nuts 14 and bolts 13 which connect the square tube 9 to the brace 5.

Attached to the square tube 9 by the nuts 14 and bolts 13 is a toothed member 10 comprising:

1. a teeth supporter such as a flat hard strip-like steel plate 11 and
2. rigid teeth 12 extending from the plate 11.

Actually, the toothed member is a steel plate with the teeth cut into it. Plastic plugs 16 close the ends of the square tube 9 to improve the appearance of the rake 4.

A magnetic rubber strip 15 is glued onto the bottom surface of the square tube 9.

When staples fall onto carpet, the staples become lodged in various ways and positions. In order for the rake 4 to best dislodge these staples, it is best that the size of the teeth 12 and the spaces between the teeth have certain relationships with the size of the staples 1 to be dislodged. FIG. 4 shows three teeth of a toothed member to define meanings of the distance f between two teeth 12 and of the bottoms 20 of teeth.

FIGS. 5 and 6 show a staple 1 whose side portions 3 are imbeded in carpet 18, that is to say whose side portions 3 are stuck down into the carpet 18. To dislodge this type of lodging, the teeth 12 are pressed down in the carpet 18 as shown such that the bottoms 20 of the teeth 12 are lower than the staple's mid portion 2. This is done by pressing down on the stick 7 of the handle as illustrated in FIG. 7. At the same time the stick 7 is pulled such that the teeth 12 approach the staple 1 as shown in FIG. 6 and press against the staple 1 as shown in FIG. 5. The bottoms 20 of the teeth 12 are rounded to lessen the friction with the carpet 18.

The rake 4 is built sturdy throughout to withstand the constant pressing and pulling. The teeth are spaced such that if the teeth 12 approach a staple as shown with one of the spaces 21 in line with a side portion 3, then another space 22 will be in line with another side portion 3. This is so that the teeth 12 will catch the staple 1 as shown in FIG. 8 such that the side portions 3 fit into the spaces 21 and 22. To accomplish this each tooth must be a distance from some other tooth greater than the outside mid portion length b. In order to lessen the likelihood of a staple 1 turning out of a fit or catch as shown in FIG. 9, the distance between any two such teeth should also be less than the staple's diagonal length e. Also there should be at least one tooth 23 between any two such teeth so that the tooth 23 will press against the mid portion 2 as the stick 7 is pulled. The stick 7 must also be pressed down with enough force to prevent the teeth 23 against the mid portion 2 from slipping over the mid portion 2 as the stick 7 is pulled.

Figure 10:
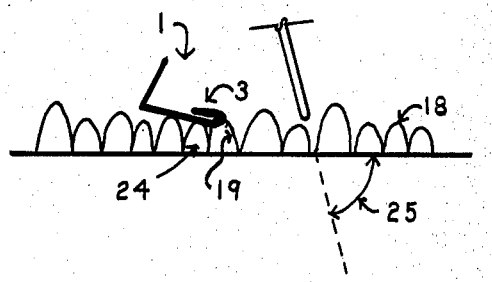
FIG. 10 is a side view of the teeth of a rake approaching a hooked staple.
Figure 11:
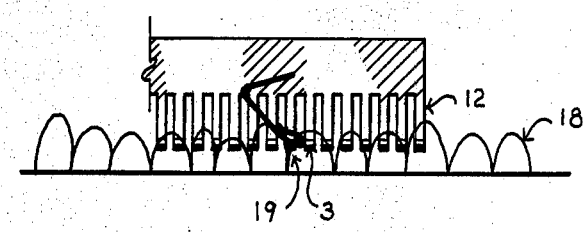
FIG. 11 is a front view of the teeth of a rake pressing against a hooked staple.

FIGS. 10 and 11 show a staple 1 whose side portion 3 is hooked around carpet thread 19. To dislodge this type lodging the teeth 12 are pressed down in the carpet 18 and the rake 4 is pulled towards the staple 1 as shown in FIGS. 7, 10 and 11. When the teeth 12 move against the hooked side portion 3, the staple 1 will tend to bend such that the thread 19 is unhooked. When only a few strands are hooked, the strands may break instead. Most hooked portions of staples 1 are larger than three times the diameter of the staple. Therefore, the distance between adjacent teeth are less than three times the staple's diameter. However a distance of one and one half to two times the staple's diameter may be best. If the rake 4 is to be used with looped carpet as shown in FIGS. 5, 6, 10 and 11 and if the widths of the bottoms 20 of the teeth 12 are narrower than the loops, the teeth 12 will snag the loops if the teeth 12 are not movable across the carpet 18 such that the angle 25 between the ends of the teeth 12 and the surface of the carpet 18 between the teeth 12 and the staple is acute.

The rake 4 is for use where several lodged staples 1 are contacted by the teeth 12 with each stroke of the rake 4. With a single stroke, all of the staples 1 contacted by the teeth 12 will probably not be dislodged because a staple 1 can be lodged in more than one way. Also some staples 1 may slide between the teeth 12. However, when the area of carpet is raked over in different directions repeatedly, over 90% of the staples will be dislodged. As the staples are dislodged, they are collected by the magnet 15. Sometimes the magnet 15 collects the staples on the same stroke that they become dislodged, and and sometimes on a different stroke over the staples. The magnet 15 is positioned at a level higher than the teeth such that the staples 1 on the magnet 15 will not be brushed off by the carpet during a stroke.

Figure 12:
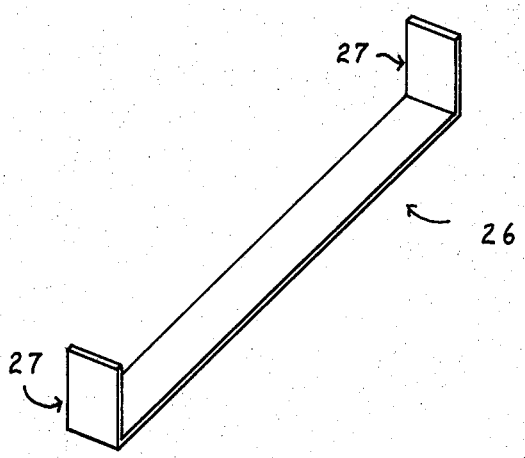
FIG. 12 is a perspective view of a plastic clip-on strip.
Figure 13:
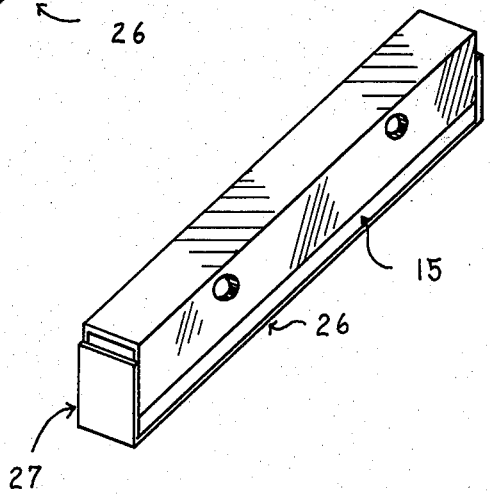
FIG. 13 is a perspective view of the strip in FIG. 12 clipped onto the square tube of a rake.

FIGS. 12 and 13 show a thin hard strip 26 of plastic with resilient sides 27 which hold the strip 26 against the bottom of the magnet 15. With the strip 26 in place, the staples collect on the strip 26. To remove collected staples 1, the rake 4 is held over a trash can, and the strip 26 is pulled from the magnet 15. This causes the staples 1 to fall into the trash can.

Figure 15:
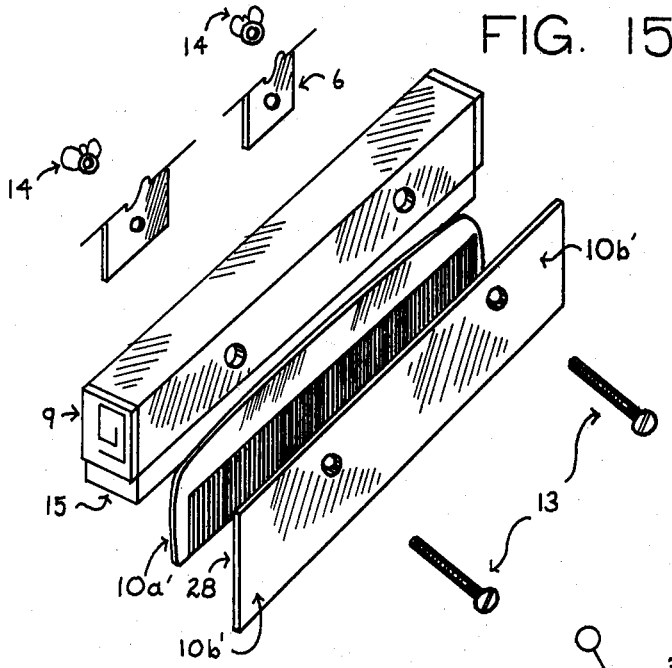
FIG. 15 is an exploded view of the rake in FIG. 14.
Figure 18:
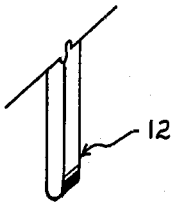
FIG. 18 is a perspective view of the lower portion of a tooth of FIG. 3, FIG. 14, or FIG. 17 showing the rounded bottom.
Figure 14:
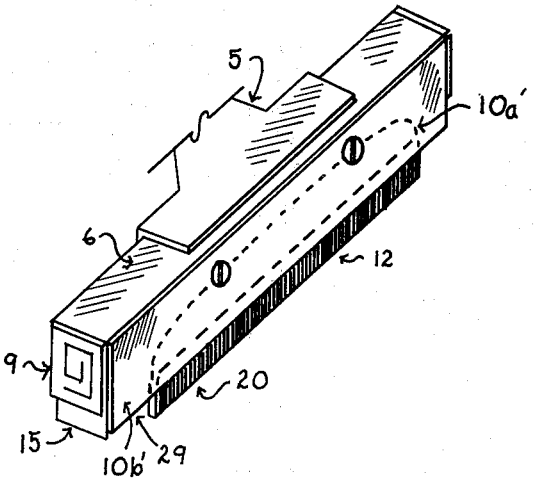
FIG. 14 is a perspective view of a rake using an aluminum hair comb as a toothed member.

All parts of the rake 4 as described above except the plate 10 and strip 26 can be easily made from stock parts. In order for the entire invention to be made using only stock parts as shown in FIGS. 14 and 15, the toothed plate 10 is replaced with an aluminum hair comb having proper tooth spacing. By coincidence an aluminum hair comb 10*a*′ made in Hong Kong with the following identification has the proper tooth spacing: 8225 DIAN.

The comb 10*a*′ is held in place by a flat sided member such as an aluminum bar 10*b*′ which is connected to the flat portion of the square tube 9 by bolts 13 and wing nuts 14′. The flat side 28 of the bar 10*b*′ is flush against the teeth 12 and the bottom 29 of the bar 10*b*′ is between the top of the teeth 12 and the bottoms 20 of the teeth 12 to resist the bending of the teeth in the direction of the bar 10*b*′. Even with this support of the rigid comb teeth 12, the teeth 12 bend with use. However, the device is effective. Periodically the hair comb 10*a*′ can be replaced by simply loosening the wing nuts 14′. If no strip 26 is used the staples 1 can be brushed off the magnet with the fingers or with a small brush.

Figure 16:
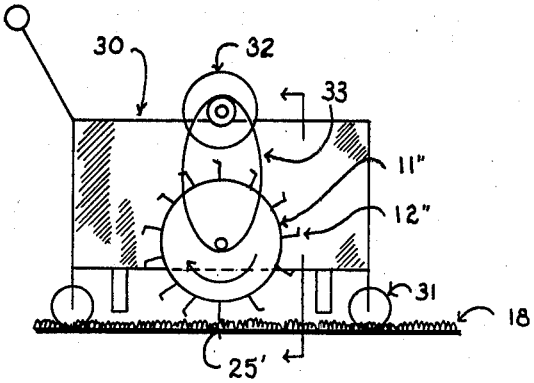
FIG. 16 is a side schematic of a machine embodiment of the invention.
Figure 17:
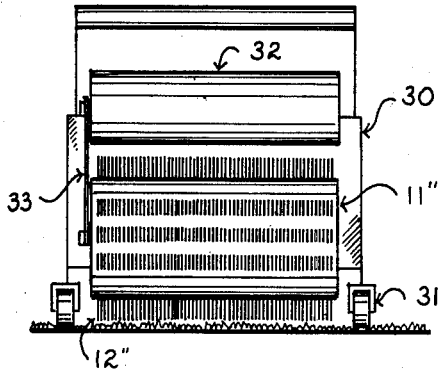
FIG. 17 is a front cutaway schematic of the machine embodiment along line 17—17 of FIG. 16.

The invention could also be made into a motorized machine as illustrated in FIGS. 16 and 17. A toothed member comprises 1. a teeth supporter such as a drum 11″ and
2. teeth 12″ extending from the drum 11″.

The drum 11″ is supported by a frame 30 on wheels 31. The frame also supports a means of moving the toothed member such as a motor 32 connected to the drum 11″ with a belt 33. As the motor 32 turns the drum 11″ via the belt 33, the teeth 12″ press down in the carpet as they 12″ move across it. The teeth 12″ in each row of teeth are spaced as the teeth 12 of the rake 4. The teeth 12″ are bent so that the ends of the teeth 12″ meet the carpet with an acute angle 25′ to prevent snagging as with the rake 4′.

It is believed that the invention claimed herein could also be used to dislodge straight pins in carpet.

I claim:

1. A device for dislodging a standard staple whose side portions are imbedded in carpet, the standard staple having two side portions 0.25 inch in outside length, a mid portion 0.5 inch in outside length, a diagonal length of 0.559017 inch and a diameter of 0.019 inch, the device comprising:

(A) a toothed member comprising
  (1) a teeth supporter and
  (2) a plurality of rigid teeth extending from the teeth supporter such that
    (a) two of the teeth are spaced apart at their bottoms by a distance
      (1) greater than 0.5 inch and (2) less than 0.559017 inch and (b) at least one tooth other than said two teeth is positioned between said two teeth such that each tooth between said two teeth is farther from each said two teeth than 0.019 inch, and (B) means for moving the bottoms of said teeth across the carpet, the device being so arranged and constructed that as the bottoms of the teeth are so moved (1) the device will withstand enough force pressing the teeth downward to prevent the bottom of at least one said tooth between said two teeth from slipping over the midportion, and (2) the device will withstand enough force pressing the teeth against the mid portion to dislodge the staple.

2. A device for dislodging a lodged standard staple having a side portion hooked around a carpet thread such that the distance across the hooked portion is greater than 0.057 inch, the standard staple having two side portions 0.25 inch in outside length, a mid portion 0.5 inch in outside length, a diagonal length of 0.559017 inch, and a diameter of 0.019 inch, the device comprising:

(A) a toothed member comprising:

(1) a teeth supporter and (2) a plurality of rigid teeth extending from the teeth supporter such that the distance between the bottoms of said adjacent teeth is less than 0.057 inch and (B) a substantially rod shaped handle attached at one end of said handle to the teeth supporter such that the device is rake shaped, the device being so arranged and constructed that as the bottoms of the teeth are moved across the carpet by the handle, the device will withstand enough force pressing the teeth against the hooked side portion to dislodge the staple.

3. A device for dislodging a standard staple lodged in carpet, the standard staple having two side portions 0.25 inch in outside length, a mid portion 0.5 inch in outside length, a diagonal length of 0.559017 inch and a diameter of 0.019 inch, the device comprising:

(A) a toothed member comprising (1) a teeth supporter, (2) a plurality of rigid teeth extending from the teeth supporter such that (a) the distance between the bottoms of adjacent said teeth is less than 0.057 inch, (b) the distance between the bottoms of adjacent said teeth is greater than 0.019 inch, and (c) for any space between a couple of adjacent said teeth, there is another space between a second couple of adjacent said teeth such that of said couples, the distance between the two teeth that are farthest apart is (1) greater than 0.5 inch and (2) less than 0.55017 inch, and (B) means for moving the bottoms of said teeth across the carpet, the device being so constructed and arranged that the device will withstand enough force pressing (1) the toothed member downward to prevent the bottoms of the teeth from slipping over the staple as the teeth move against the staple and (2) the teeth against the staple to dislodge the staple.

4. A device of claim 1 or 3 wherein the means for moving the toothed member comprises a handle attached to the toothed member such that the toothed member is manually so movable by the handle.

5. A device of claim 4 wherein

A. the handle is substantially rod shaped,

B. the teeth supporter is a flat strip of hard material such that the toothed member is substantially comb shaped, and C. the teeth supporter is attached to one end of the handle such that the device is substantially rake shaped.

6. A device of claim 1 wherein the distance between the bottoms of said adjacent teeth is (A) greater than 0.019 inch and (B) less than 0.057 inch.

7. A device of claim 2, 3, or 6 wherein the said distance between the bottoms of said adjacent teeth is less than 0.038 inch.

8. A device of claim 2 wherein the means for moving the toothed member comprises a handle attached to the toothed member such that the toothed member is manually so movable by the handle.

9. A device of claim 2 or 3 wherein the distance between the bottoms of adjacent teeth is less than 0.038 inch.

* * * * *